US007387691B2

(12) United States Patent
Suzuki et al.

(10) Patent No.: US 7,387,691 B2
(45) Date of Patent: Jun. 17, 2008

(54) HOT FORGED NON-HEAT TREATED STEEL FOR INDUCTION HARDENING

(75) Inventors: Daisuke Suzuki, Kitakyushu (JP); Hitoshi Matsumoto, Kitakyushu (JP); Hideki Imataka, Kitakyushu (JP); Hayato Onda, Wako (JP); Tetsuya Asai, Wako (JP)

(73) Assignees: Sumitomo Metal Industries, Ltd., Osaka (JP); Honda Motor Co., Ltd., Tokyo (JP)

( * ) Notice: Subject to any disclaimer, the term of this patent is extended or adjusted under 35 U.S.C. 154(b) by 57 days.

(21) Appl. No.: 11/360,476

(22) Filed: Feb. 24, 2006

(65) Prior Publication Data

US 2006/0137771 A1 Jun. 29, 2006

Related U.S. Application Data

(63) Continuation of application No. PCT/JP2004/012100, filed on Aug. 24, 2004.

(30) Foreign Application Priority Data

Aug. 27, 2003 (JP) ..... 2003-302691

(51) Int. Cl.
*C22C 38/28* (2006.01)
*C22C 38/60* (2006.01)

(52) U.S. Cl. ..... 148/333; 420/84; 420/87; 420/110; 420/111; 420/104

(58) Field of Classification Search ..... 420/104–106, 420/110, 84, 87, 111; 148/333–334, 320
See application file for complete search history.

(56) References Cited

U.S. PATENT DOCUMENTS

| | | | | |
|---|---|---|---|---|
| 6,783,728 | B2 * | 8/2004 | Kano et al. | 420/84 |
| 6,797,231 | B2 * | 9/2004 | Matsui et al. | 420/84 |
| 6,838,048 | B2 * | 1/2005 | Nishi et al. | 420/84 |
| 2003/0084965 | A1 | 5/2003 | Nishi et al. | |

FOREIGN PATENT DOCUMENTS

| | | |
|---|---|---|
| EP | 1312689 A1 | 5/2003 |
| JP | 63-100157 | 5/1988 |
| JP | 2-179841 | 7/1990 |
| JP | 7-090484 | 4/1995 |
| JP | 10-046287 | 2/1998 |
| JP | 2916069 | 4/1999 |
| JP | 11-350065 | 12/1999 |
| JP | 2000-160285 | 6/2000 |
| JP | 2000-160286 | 6/2000 |
| JP | 3267164 | 1/2002 |
| JP | 2003-147434 | 5/2003 |

* cited by examiner

*Primary Examiner*—Deborah Yee
(74) *Attorney, Agent, or Firm*—Clark & Brody

(57) ABSTRACT

A hot forged non-heat treated steel for induction hardening, comprising by mass percent, C: 0.35 to 0.45%, Si: 0.20 to 0.60%, Mn: 0.40 to 0.80%, S: 0.040 to 0.070%, Cr: 0.10 to 0.40%, Ti: 0.020 to 0.100%, Ca: 0.0005 to 0.0050%, B: 0.0005 to 0.0030%, O: 0.0015 to 0.0050%, Mo: 0 to 0.05%, P: 0.025% or less, V: 0.03% or less, Al: 0.009% or less and N: 0.0100% or less, and the balance being Fe and impurities, with $Fn1=C+(Si/10)+(Mn/5)+(5Cr/22)+1.65V-(5/7S)+1.51\times(Ti-3.4N)\leqq 0.63$, $Ca/O\leqq 1.0$, and $25.9\times Fn1+27.5\times(Ti-3.4N)-7.9\geqq 5.7$, has more excellence in the machinability than a conventional steel and also has fatigue strength equal to or more than that of a conventional steel, while using the steel product in a hot forged state as a starting material.

1 Claim, 3 Drawing Sheets

HOT FORGED NON-HEAT TREATED STEEL FOR INDUCTION HARDENING

This application is a continuation of the international application PCT/JP2004/012100 filed on Aug. 24, 2004, the entire content of which is herein incorporated by reference.

TECHNICAL FIELD

The present invention relates to a hot forged non-heat treated steel for induction hardening, more specifically it relates to a hot forged non-heat treated steel for induction hardening suitable for making machine structural parts such as a crankshaft used in an automobile or an industrial vehicle and the like.

BACKGROUND ART

Conventionally, a steel for machine structural use, such as S48C etc. regulated in JIS has been employed for a crankshaft and the like used for an automobile, an industrial vehicle and the like, since they require wear resistance and fatigue strength. The said S48C is a so-called "heat treated steel", therefore, the wear resistance and the fatigue strength thereof are improved by performing the following treatments. That is to say, first, in order to attain a predetermined strength, a quench hardening and tempering treatment after hot working is performed. Second, the said quench hardened and tempered S48C is made into a predetermined shape by machining or the like. Finally, an induction hardening treatment to necessary parts is carried out in order to form a surface hardened layer.

However, the heat treated steel, as described above, consumes a lot of energy and labor hours, and also requires high facility cost because the quench hardening and tempering heat-treatment is performed after hot forging. In recent years, therefore, the development of a non-heat treated steel usable in a hot forged state has been actively carried out in order to respond to the social need of energy saving, and several reports for non-heat treated steel for induction hardening have been made.

For example, the Patent Document 1 discloses "a non-heat treated steel for induction hardening, which comprises by weight percent, C: 0.30 to 0.60%, Si: 0.03 to 1.0%, Mn: 0.5 to 2.0%, and further one or two of Mo: 0.05 to 0.5% and Nb: 0.01 to 0.3%, with the balance being substantially Fe, and having a microstructure in which the volume ratio of bainite is regulated to 75% or more", and the like.

Further, the Patent Document 2 discloses "a non-heat treated steel for induction hardening, which comprises by weight ratio, C: 0.30 to 0.60%, Si: 0.10 to 0.80%, Mn: 0.60 to 2.00%, Cr: 0.60% or less, V: 0.05 to 0.30%, Al: 0.030 to 0.100%, N: 0.0080 to 0.0200% and B: 0.0005 to 0.0050%, with the balance being Fe and impurities", and the like.

Patent Document 1: Japanese Laid-Open Patent Publication No. 63-100157

Patent Document 2: Japanese Laid-Open Patent Publication No. 2-179841

DISCLOSURE OF THE INVENTION

Subject to be Solved by the Invention

The objective of the present invention is to provide a hot forged non-heat treated steel for induction hardening, improved in machinability compared to a conventional steel and having fatigue strength equal to or more than that of a conventional steel, while using the steel product in a hot forged state as a starting material.

The steel proposed in the said Patent Document 1 has a problem of deterioration of machinability and that is one of the important characteristics required for the steels for machine structural use, since its core material has a microstructure whose bainite ratio is 75% or more.

The technique proposed in the Patent Document 2 has a problem of deterioration of machinability. That is to say, V is added in order to ensure the internal strength equal to a conventional steel and a relatively large quantity of Al is added in order to fix N sufficiently. However an excessive addition of Al leads to the formation of a hard $Al_2O_3$ phase. Therefore, the combination with the addition of V and an excessive addition of Al causes deterioration of machinability.

In order to solve the above-mentioned problems, the present inventors made various examinations, particularly, improving the machinability of hot forged non-heat treated steel and also ensuring the fatigue strength when an induction hardening treatment was performed, and obtained the following knowledge.

(a) In order to significantly improve the machinability, reduction in the internal hardness, namely control of the carbon equivalent amount regulated by Fn1, represented by the equation (1), which is described later, to 0.63 or less is needed, and moreover an addition of S and Ca that are free cutting elements, limitation of Al content in order to ensure chip disposability, and control of the value of Fn2, represented by the equation (2), which is described later, to 1.0 or less are needed.

(b) In order to ensure the fatigue strength equal to a conventional steel (e.g., a steel obtained by performing a quench hardening and tempering treatment to S48C regulated by JIS or the like), as shown in FIG. 1, it is necessary to increase the hardened case depth in the induction hardening treatment shown by (b) in FIG. 1, depending on the reduction in the internal hardness shown by (a) in FIG. 1. And moreover, in order to obtain a predetermined hardened case depth, it is necessary to add B that has a hardenability improving effect and to control of the value of Fn3, represented by the equation (3), which is described later, to 5.7 or more. Further, control of V content to 0.03% or less is required in order to inhibit the formation of a vanadium carbonitride that is a nucleus for ferrite precipitation in the non-heat treated steel.

The present invention has been accomplished based on the above knowledge.

Means for Solving the Problem

The gist of the present invention is following (1), that is to say, a hot forged non-heat treated steel for induction hardening.

(1) A hot forged non-heat treated steel for induction hardening, which comprises by mass percent, C: 0.35 to 0.45%, Si: 0.20 to 0.60%, Mn: 0.40 to 0.80%, S: 0.040 to 0.070%, Cr: 0.10 to 0.40%, Ti: 0.020 to 0.100%, Ca: 0.0005 to 0.0050%, B: 0.0005 to 0.0030%, 0 (oxygen): 0.0015 to 0.0050%, Mo: 0 to 0.05%, P: 0.025% or less, V: 0.03% or less, Al: 0.009% or less and N: 0.0100% or less, with the balance being Fe and impurities, in which the value of Fn1 represented by the following equation (1) is 0.63 or less, the value of Fn2 represented by the following equation (2) is 1.0 or less, and the value of Fn3 represented by the following equation (3) is 5.7 or more:

$$Fn1=C+(Si/10)+(Mn/5)+(5Cr/22)+1.65V-(5/7S)+1.51\times(Ti-3.4N), \quad \text{Equation (1):}$$

$$Fn2=Ca/O, \quad \text{Equation (2):}$$

$$Fn3=25.9\times Fn1+27.5\times(Ti-3.4N)-7.9. \quad \text{Equation (3):}$$

Each element symbol appearing in the above-mentioned equations (1), (2) and (3) represents the content by mass percent of the corresponding element.

Hereinafter, the steel described in the above (1) is referred to as the Invention (1).

Effect of the Invention

The hot forged non-heat treated steel for induction hardening of the present invention has more excellence in machinability than a conventional steel and also has fatigue strength equal to or more than a conventional steel, while using the steel product in a hot forged state as a starting material.

BEST MODE FOR CARRYING OUT THE INVENTION

Each requirement of the present invention will next be described in detail. In the following description, the symbol "%" for content of each element means "mass percent".

(A) Chemical Compositions

C: 0.35 to 0.45%

C has an effect of improving hardenability and the internal strength, and in order to ensure minimum hardenability and internal strength, it is necessary to include 0.35% or more of C. On the other hand, if the content of C exceeds 0.45%, the hardness of the core material is raised, resulting in deterioration of machinability. Therefore, the content of C is set to 0.35 to 0.45%. The more preferable range of C content is 0.35 to 0.40%.

Si: 0.20 to 0.60%

Si is necessary as a deoxidizing agent of steel and has an effect of strengthening ferrite to improve the fatigue strength. In order to obtain these effects, it is necessary to include 0.20% or more of Si. On the other hand, a content of Si exceeding 0.60% promotes decarburization in hot forging, resulting in deterioration of strength. Therefore, the content of Si is set to 0.20 to 0.60%. The more preferable range of Si content is 0.30 to 0.50%.

Mn: 0.40 to 0.80%

Mn is necessary as a deoxidizing agent of steel and has an effect of improving hardenability so as to raise the strength of steel. In order to obtain these effects, it is necessary to include 0.40% or more of Mn. On the other hand, a content of Mn exceeding 0.80% raises the material hardness, resulting in reduction in machinability. Therefore, the content of Mn is set to 0.40 to 0.80%. The more preferable range of Mn content is 0.50 to 0.70%.

S: 0.040 to 0.070%

S has an effect of improving the machinability by forming MnS with Mn. In order to obtain this effect, it is necessary to include 0.040% or more of S. On the other hand, a content of S exceeding 0.070% leads to not only deterioration of hot forgeability of the steel but also a reduction in fatigue strength. Therefore, the content of S is set to 0.040 to 0.070%. The more preferable range of S content is 0.040 to 0.060%.

Cr: 0.10 to 0.40%

Cr has an effect of improving the hardenability of steel so as to enhance the strength. In order to obtain a desired effect, it is necessary to include 0.10% or more of Cr. On the other hand, a content of Cr exceeding 0.40% leads to not only deterioration of hot forgeability of the steel but also a reduction in the machinability. Therefore, the content of Cr is set to 0.10 to 0.40%. The more preferable range of Cr content is 0.10 to 0.20%.

Ti: 0.020 to 0.100%

Ti is used as a deoxidizing agent of steel, and also has an effect of fixing N by bonding with N in the steel and generating TiN. Moreover the dissolved Ti in the steel has an effect of strengthening the steel. In the steel of the present invention, the content of Al is small, and it is needed to fix N by Ti in order to inhibit the generation of BN in the case of the addition of B. In order to obtain a desired effect, it is necessary to include 0.020% or more of Ti. On the other hand, if the content of Ti exceeds 0.100%, the machinability of the steel is reduced. Therefore, the content of Ti is set to 0.020 to 0.100%. The more preferable range of Ti content is 0.030 to 0.060%.

Ca: 0.0005 to 0.0050%

Ca has an effect of significantly improving the machinability of steel by dispersing MnS finely. In order to obtain this effect, it is necessary to include 0.0005% or more of Ca. On the other hand, if the content of Ca exceeds 0.0050%, not only the machinability improving effect of Ca is saturated, but also coarse Ca-based oxides are formed so as to deteriorate the fatigue strength. Therefore, the content of Ca is set to 0.0005 to 0.0050%. The more preferable range of Ca content is 0.0005 to 0.0030%

B: 0.0005 to 0.0030%

B has an important effect of improving the hardenability of steel. In the present invention, in order to reduce the internal hardness and improve the machinability, the contents of elements enhancing the hardenability such as C, Mn and Cr are controlled to be lower than those in a conventional steel. Therefore, the addition of B is necessary for ensuring the hardened case depth in the induction hardening treatment. In order to obtain the effect of improving the hardenability, it is necessary to include 0.0005% or more of B. On the other hand, if the content of B exceeds 0.0030%, the effect of improving the hardenability is saturated. Therefore, the content of B is set to 0.0005 to 0.0030%.

O (oxygen): 0.0015 to 0.0050%

O (oxygen) has an effect of improving the machinability, particularly, inhibiting the tool wear in high-speed machining by bonding with Ca. In order to exhibit this effect, it is necessary to include 0.0015% or more of O (oxygen). On the other hand, a content of O exceeding 0.0050% adversely leads to the deterioration of the machinability or a reduction in the fatigue strength resulting from the formation of coarse oxide-based inclusions. Therefore, the content of O (oxygen) is set to 0.0015 to 0.0050%. The more preferable range of O content is 0.0015 to 0.0035%.

Mo: 0 to 0.05%

Mo can be optionally added. If it is added, the hardenability of steel is effectively improved. In order to surely obtain this effect, the content of Mo can be set to 0.02% or more. On the other hand, if the content of Mo exceeds 0.05%, not only the hot forgeability and the machinability of steel are deteriorated, but also the economic property is worse, therefore, the content of Mo is set to 0 to 0.05%.

Al: 0.009% or less

Al has an effect of deoxidizing steel. However, if it is excessively added, it bonds with oxygen so as to generate hard $Al_2O_3$ inclusions, resulting in deterioration of the machinability. Particularly, a content of Al exceeding 0.009% makes a marked deterioration of the machinability, therefore, the content of Al is set to 0.009% or less.

In the present invention, the contents of P, V and N are limited as follows. These elements are included in steel as impurities.

P: 0.025% or less

P is an inevitable impurity of steel, and the presence of a large quantity thereof in steel may promote cracking when an induction hardening treatment is performed. Particularly, a content of P exceeding 0.025% may make a marked generation of cracking in the induction hardening treatment. Therefore, the content of P is set to 0.025% or less. The P content is more preferably controlled to 0.015% or less.

V: 0.03% or less

V bonds with C and N so as to form a carbonitride. This carbonitride causes dispersion of hardness in an induction hardening treatment after hot forging, since it becomes a stable nucleus of ferrite after hot forging. Particularly, a content of V exceeding 0.03% makes a marked dispersion of hardness in the induction hardening treatment. Therefore, the content of V is set to 0.03% or less.

N: 0.0100% or less

N tends to generate TiN due to high affinity with Ti. If the content of N exceeds 0.0100%, a coarse TiN is generated, causing deterioration of fatigue strength. Therefore, the content of N is set to 0.0100% or less. The more preferable range of N content is 0.0060% or less.

The chemical composition of the hot forged non-heat treated steel for induction hardening, according to the Invention (1), comprises the above-mentioned elements of C to N and the balance being Fe and impurities.

(B) Fn1, Fn2 and Fn3

Fn1≦0.63

In order to ensure the machinability, it is effective to reduce the internal hardness, particularly in gun drilling, because the tool life is remarkably improved by reducing the internal hardness. Therefore, in order to reduce the internal hardness after hot forging, so as to obtain satisfactory machinability, the value of Fn1 which is represented in the said equation (1) is set to 0.63 or less. If the value of Fn1 is excessively low, the internal hardness may become too low to obtain sufficient strength. Therefore, the lower limit of the value of Fn1 is preferably set to about 0.50.

Fn2≦1.0

By setting Fn2 to 1.0 or less, namely by setting the ratio of Ca to O (oxygen) to 1.0 or less, MnS in steel is dispersed finely and the fine MnS exhibits a notch effect in the steel so as to remarkably improve the chip disposability. Therefore, the value of Fn2 which is represented in the said equation (2) is set to 1.0 or less. The lower limit of the value of Fn2 is not particularly regulated, but 0.1 which is calculated from 0.0005% which is the lower limit of the Ca content and 0.0050% which is the upper limit of the O (oxygen) content, corresponds to the lower limit of the value of Fn2.

Fn3≧5.7

A parameter for the hardened case depth in the induction hardening treatment is Fn3, which is represented in the said equation (3), where the content of B is 0.0005 to 0.0030% described above. In order to satisfy an improvement in the machinability and also to ensure fatigue strength, an increase in the hardened case depth in the induction hardening treatment is necessary, in addition to a reduction in the internal hardness. If the value of Fn1 and the value of Fn3 are controlled to 0.63 or less and to 5.7 or more, respectively, the hardened case depth in the induction hardening treatment can be increased without impairing the machinability. Therefore, the value of Fn3 represented by the said equation (3) is set to 5.7 or more. The upper limit of the value of Fn3 is not particularly limited. However, the elements which improve the hardened case depth in the induction hardening treatment may raise the value of Fn1, which is the index of the internal hardness as mentioned above, and also deteriorate the machinability. Therefore the upper limit of the value of Fn3 is preferably set to about 10.0.

In a case where the content of B is less than 0.0005%, the parameter for the hardened case depth in the induction hardening treatment is 0.56 times Fn3, which is represented in the said equation (3). However, even in the case where the content of B is less than 0.0005%, the parameter for the hardened case depth in the induction hardening treatment is referred to as Fn3 in the following description.

Taking the result of examinations using steels shown by Test Nos. 1 to 20 in Table 1 made by the present inventors as an example, regulations for the values of Fn1 to Fn3 will be described in detail.

TABLE 1

| | Chemical composition (% by mass) Balance: Fe and impurities | | | | | | | | | | | | | |
|---|---|---|---|---|---|---|---|---|---|---|---|---|---|---|
| Test No. | C | Si | Mn | P | S | Cr | Mo | V | Al | Ti | N | B | Ca | O |
| 1 | 0.35 | 0.46 | 0.47 | 0.008 | 0.068 | 0.18 | — | 0.01 | 0.001 | 0.050 | 0.0080 | 0.0025 | 0.0009 | 0.0018 |
| 2 | 0.36 | 0.22 | 0.59 | 0.008 | 0.058 | 0.24 | 0.02 | 0.01 | 0.004 | 0.044 | 0.0080 | 0.0019 | 0.0018 | 0.0020 |
| 3 | 0.36 | 0.47 | 0.43 | 0.008 | 0.041 | 0.22 | — | 0.01 | 0.001 | 0.042 | 0.0060 | 0.0025 | 0.0011 | 0.0025 |
| 4 | 0.35 | 0.21 | 0.58 | 0.008 | 0.055 | 0.33 | — | 0.01 | 0.004 | 0.038 | 0.0080 | 0.0016 | 0.0011 | 0.0035 |
| 5 | 0.37 | 0.49 | 0.47 | 0.010 | 0.044 | 0.12 | — | 0.01 | 0.002 | 0.048 | 0.0080 | 0.0017 | 0.0011 | 0.0025 |
| 6 | 0.35 | 0.45 | 0.73 | 0.011 | 0.046 | 0.11 | 0.02 | 0.01 | 0.004 | 0.046 | 0.0090 | 0.0014 | 0.0014 | 0.0022 |
| 7 | 0.39 | 0.50 | 0.59 | 0.011 | 0.044 | 0.12 | — | 0.01 | 0.005 | 0.046 | 0.0080 | 0.0012 | 0.0021 | 0.0036 |
| 8 | 0.36 | 0.44 | 0.47 | 0.011 | 0.040 | 0.28 | — | 0.01 | 0.001 | 0.045 | 0.0100 | 0.0020 | 0.0012 | 0.0032 |
| 9 | 0.38 | 0.56 | 0.55 | 0.011 | 0.041 | 0.22 | — | 0.01 | 0.003 | 0.056 | 0.0070 | 0.0018 | 0.0023 | 0.0030 |
| 10 | 0.39 | 0.56 | 0.55 | 0.011 | 0.040 | 0.22 | — | 0.01 | 0.001 | 0.049 | 0.0100 | 0.0020 | 0.0011 | 0.0033 |
| 11 | 0.42 | 0.21 | 0.84 | 0.015 | 0.058 | 0.13 | — | 0.09 | 0.002 | 0.003 | 0.0070 | — | 0.0013 | 0.0031 |
| 12 | 0.39 | 0.20 | 0.82 | 0.011 | 0.042 | 0.22 | — | 0.10 | 0.002 | 0.001 | 0.0100 | — | 0.0013 | 0.0024 |
| 13 | 0.38 | 0.20 | 0.80 | 0.012 | 0.044 | 0.18 | 0.02 | 0.01 | 0.003 | 0.038 | 0.0060 | 0.0019 | 0.0022 | 0.0015 |
| 14 | 0.40 | 0.22 | 0.85 | 0.013 | 0.042 | 0.18 | 0.02 | 0.01 | 0.004 | 0.035 | 0.0070 | 0.0014 | 0.0021 | 0.0015 |
| 15 | 0.38 | 0.23 | 0.84 | 0.010 | 0.046 | 0.14 | — | 0.01 | 0.004 | 0.002 | 0.0060 | — | 0.0021 | 0.0026 |
| 16 | 0.39 | 0.48 | 0.58 | 0.009 | 0.046 | 0.14 | — | 0.01 | 0.006 | 0.001 | 0.0070 | — | 0.0020 | 0.0016 |
| 17 | 0.48 | 0.20 | 0.71 | 0.012 | 0.041 | 0.16 | 0.02 | 0.01 | 0.006 | 0.005 | 0.0070 | — | 0.0009 | 0.0021 |
| 18 | 0.46 | 0.22 | 0.69 | 0.008 | 0.044 | 0.16 | — | 0.01 | 0.003 | 0.004 | 0.0080 | — | 0.0012 | 0.0016 |
| 19 | 0.46 | 0.22 | 0.83 | 0.016 | 0.053 | 0.16 | 0.02 | 0.01 | 0.002 | 0.031 | 0.0060 | 0.0016 | 0.0012 | 0.0017 |
| 20 | 0.45 | 0.20 | 0.81 | 0.009 | 0.061 | 0.13 | — | 0.01 | 0.002 | 0.033 | 0.0050 | 0.0022 | 0.0009 | 0.0013 |

The steels having chemical compositions shown in Table 1 were melted using a 3-ton electric furnace, cast and stood to cool in an ingot state. Then, each ingot was made into a 180 mm-cubic billet by blooming, and then heated to 1200° C. or higher by a normal method so as to form steel bars of 100 mm and 20 mm in diameter by hot rolling.

The steel bar, which is 100 mm in diameter, was subjected to high-temperature normalizing and held at 1200° C. for 60

The machinability was examined by using a cemented carbide-made gun drill, 6.2 mm in diameter to bore 300 holes of a cutting depth of 55 mm vertically to cut faces of the test specimens at a revolution of 6000 rpm and a feed of 200 mm/min by use of a water soluble lubricant, and evaluated based on the presence/absence of breakage of the gun drill.

The chip disposability was evaluated based on whether or not the chips discharged in the above machining test include those of 30 mm or more in length. That is to say, the chip disposability was determined as poor when the chips included those of 30 mm or more in length, and the chip disposability was determined as excellent when the chips did not include those of 30 mm or more in length.

On the other hand, the steel bar, which is 20 mm in diameter, was subjected to high-temperature normalizing and held at 1200° C. for 30 minutes, followed by standing to cool, then the test specimens for the Ono-type rotating bending fatigue test, with a parallel part 10 mm in diameter were obtained from the resulting steel bar of 20 mm in diameter. Following this, the parallel part of the test specimens was subjected to an induction hardening treatment at an output of 50 kW and a frequency of 200 kHz, and low-temperature tempering at 150° C. for 30 minutes, the Ono-type rotating bending fatigue test was then performed.

The rotating bending fatigue characteristic was evaluated as follows: the Ono-type rotating bending fatigue test was carried out at room temperature by a normal method using the above-mentioned JIS No. 1 test specimen for the rotating bending fatigue test having a parallel part diameter of 10 mm, a parallel part length of 30 mm, and a corner part radius of 30 mm. The stress in a repetition frequency of $1.0\times10^7$ was evaluated as rotating bending fatigue strength. If the rotating bending fatigue strength is 500 MPa or more, it would exceed the rotating bending fatigue strength of a hot-forged material of S48C regulated in JIS. Therefore, the target for the rotating bending fatigue characteristic was set to obtain the rotating bending fatigue strength of 500 MPa or more.

The test results are shown in FIG. 2 and FIG. 3.

FIG. 2 shows the relationship between Fn1 and Fn2 in terms of the machinability.

As is apparent from FIG. 2, the machinability (gun drill life and chip disposability) is enhanced by setting the value of Fn1 to 0.63 or less and the value of Fn2 to 1.0 or less.

FIG. 3 shows the relationship between Fn1 and Fn3 in terms of the rotating bending fatigue characteristic and the machinability. In FIG. 3, those with an Fn2 value exceeding 1.0 are excluded.

As is apparent from FIG. 3, the rotating bending fatigue characteristic and the machinability are enhanced by setting the value of Fn1 to 0.63 or less and the value of Fn3 to 5.7 or more. That is to say, it is found that the fatigue strength was improved and the machinability was also improved by setting the value of Fn1 to 0.63 or less, the value of Fn2 to 1.0 or less, and the value of Fn3 to 5.7 or more.

PREFERRED EMBODIENT

The present invention will be described in more detail in reference to preferred embodiment.

EXAMPLE

The steels of Test Nos. 1 to 20 shown in Table 1 were melted using a 3-ton electric furnace, cast and stood to cool in an ingot state. The steels of Test Nos. 1 to 10 in Table 1 are steels of inventive examples having chemical compositions within the range regulated by the present invention, and the steels of Nos. 11 to 20 in Table 1 are steels of comparative examples with chemical compositions out of the range regulated by the present invention.

Each ingot was made into a 180 mm-cubic billet by blooming, and then heated to 1200° C. or higher by a normal method so as to form steel bars of 100 mm and 20 mm in diameter by hot rolling.

The steel bar, which is 100 mm in diameter, was subjected to high-temperature normalizing and held at 1200° C. for 60 minutes followed by standing to cool, and then cut in a length of 70 mm, whereby machinability evaluation test specimens were obtained.

The machinability was examined by using a cemented carbide-made gun drill, 6.2 mm in diameter to bore 300 holes of a cutting depth of 55 mm vertically to cut faces of the test specimens at a revolution of 6000 rpm and a feed of 200 mm/min by use of a water soluble lubricant, and evaluated based on the presence/absence of breakage of the gun drill.

The chip disposability was evaluated based on whether or not the chips discharged in the above machining test include those of 30 mm or more in length. That is to say, the chip disposability was determined as poor when the chips included those of 30 mm or more in length, and the chip disposability was determined as excellent when the chips did not include those of 30 mm or more in length.

On the other hand, the steel bar, which is 20 mm in diameter, was subjected to high-temperature normalizing and held at 1200° C. for 30 minutes, followed by standing to cool, then the test specimens for the Ono-type rotating bending fatigue test, with a parallel part 10 mm in diameter were obtained from the resulting steel bar of 20 mm in diameter. Following this, the parallel part of the test specimens was subjected to an induction hardening treatment at an output of 50 kW and a frequency of 200 kHz, and low-temperature tempering at 150° C. for 30 minutes, the Ono-type rotating bending fatigue test was then performed.

The rotating bending fatigue characteristic was evaluated as follows: the Ono-type rotating bending fatigue test was carried out at room temperature by a normal method using the above-mentioned JIS No. 1 test specimen for the rotating bending fatigue test having a parallel part diameter of 10 mm, a parallel part length of 30 mm, and a corner part radius of 30 mm. The stress in a repetition frequency of $1.0\times10^7$ was evaluated as rotating bending fatigue strength. If the rotating bending fatigue strength is 500 MPa or more, it would exceed the rotating bending fatigue strength of a hot-forged material of S48C regulated in JIS. Therefore, the target for the rotating bending fatigue characteristic was set to obtain the rotating bending fatigue strength of 500 MPa or more.

Each of the test results is summarized in Table 2.

TABLE 2

| | | | | Machinability | | Ono-type rotating bending fatigue test | |
|---|---|---|---|---|---|---|---|
| Test No. | Fn1 | Fn2 | Fn3 | Drill life | Chip disposability | Fatigue strength (MPa) | Remarks |
| 1 | 0.53 | 0.50 | 6.5 | ○ | ○ | 510 | Inventive |
| 2 | 0.55 | 0.90 | 6.9 | ○ | ○ | 519 | Example |

TABLE 2-continued

| Test No. | Fn1 | Fn2 | Fn3 | Machinability: Drill life | Machinability: Chip disposability | Ono-type rotating bending fatigue test: Fatigue strength (MPa) | Remarks |
|---|---|---|---|---|---|---|---|
| 3 | 0.56 | 0.44 | 7.3 | ○ | ○ | 539 | |
| 4 | 0.56 | 0.31 | 6.8 | ○ | ○ | 519 | |
| 5 | 0.56 | 0.44 | 7.1 | ○ | ○ | 559 | |
| 6 | 0.57 | 0.64 | 7.4 | ○ | ○ | 578 | |
| 7 | 0.60 | 0.58 | 8.1 | ○ | ○ | 657 | |
| 8 | 0.57 | 0.38 | 7.1 | ○ | ○ | 549 | |
| 9 | 0.63 | 0.77 | 9.4 | ○ | ○ | 853 | |
| 10 | 0.62 | 0.33 | 8.5 | ○ | ○ | 715 | |
| 11 | 0.71 | 0.42 | 5.6 | X | ○ | 647 | Comparative |
| 12 | 0.71 | 0.54 | 5.4 | X | ○ | 617 | Example |
| 13 | 0.61 | 1.47 | 8.4 | X | X | 676 | |
| 14 | 0.64 | 1.40 | 8.9 | X | X | 764 | |
| 15 | 0.56 | 0.81 | 3.4 | ○ | ○ | # 412 | |
| 16 | 0.54 | 1.25 | 3.0 | X | X | # 363 | |
| 17 | 0.64 | 0.43 | 4.5 | X | ○ | # 480 | |
| 18 | 0.61 | 0.75 | 4.0 | ○ | ○ | # 461 | |
| 19 | 0.68 | 0.71 | 10.0 | X | ○ | 813 | |
| 20 | 0.66 | 0.69 | 9.6 | X | ○ | 794 | |

A mark ○ in the "Drill life" column shows that 300 holes could be bored.
A mark X in the "Drill life" column shows that the drill was broken before boring 300 holes.
A mark ○ in the "Chip disposability" column shows that chips are free from those of 30 mm or more in length.
A mark X in the "Chip disposability" column shows that chips include those of 30 mm or more in length.
A mark # shows that 500 MPa that is the target rotating bending fatigue strength is not attained.

It is apparent from Table 2, in the case of Test Nos. 11 to 20 which are out of the condition regulated by the Invention (1), either the machinability is poor with poor gun drill life or chip disposability, or the fatigue strength is low.

On the other hand, in the case of Test Nos. 1 to 10 which satisfy the condition regulated by the Invention (1), fatigue strength of 500 MPa or more can be realized while improving the machinability.

Although only some exemplary embodiments of the present invention have been described in detail above, those skilled in the art will readily appreciated that many modifications are possible in the exemplary embodiments without materially departing from the novel teachings and advantages of the present invention. Accordingly, all such modifications are intended to be included within the scope of the present invention.

INDUSTRIAL APPLICABILITY

The hot forged non-heat treated steel for induction hardening of the present invention has more excellence in machinability than a conventional steel and also has fatigue strength equal to or more than that of a conventional steel, while using the steel product in a hot forged state as a starting material. Therefore, this steel can be used as a material of machine structural parts such as crankshafts for automobiles or industrial vehicles.

BRIEF DESCRIPTION OF THE DRAWINGS

FIG. 1 is a graphic representation showing the concept of ensuring the machinability and the fatigue strength.

FIG. 2 is a graphic representation showing one example of a relationship between Fn1 and Fn2 in terms of the machinability.

FIG. 3 is a graphic representation showing one example of a relationship between Fn1 and Fn3 in terms of the rotating bending fatigue characteristic and the machinability.

Figure 1:
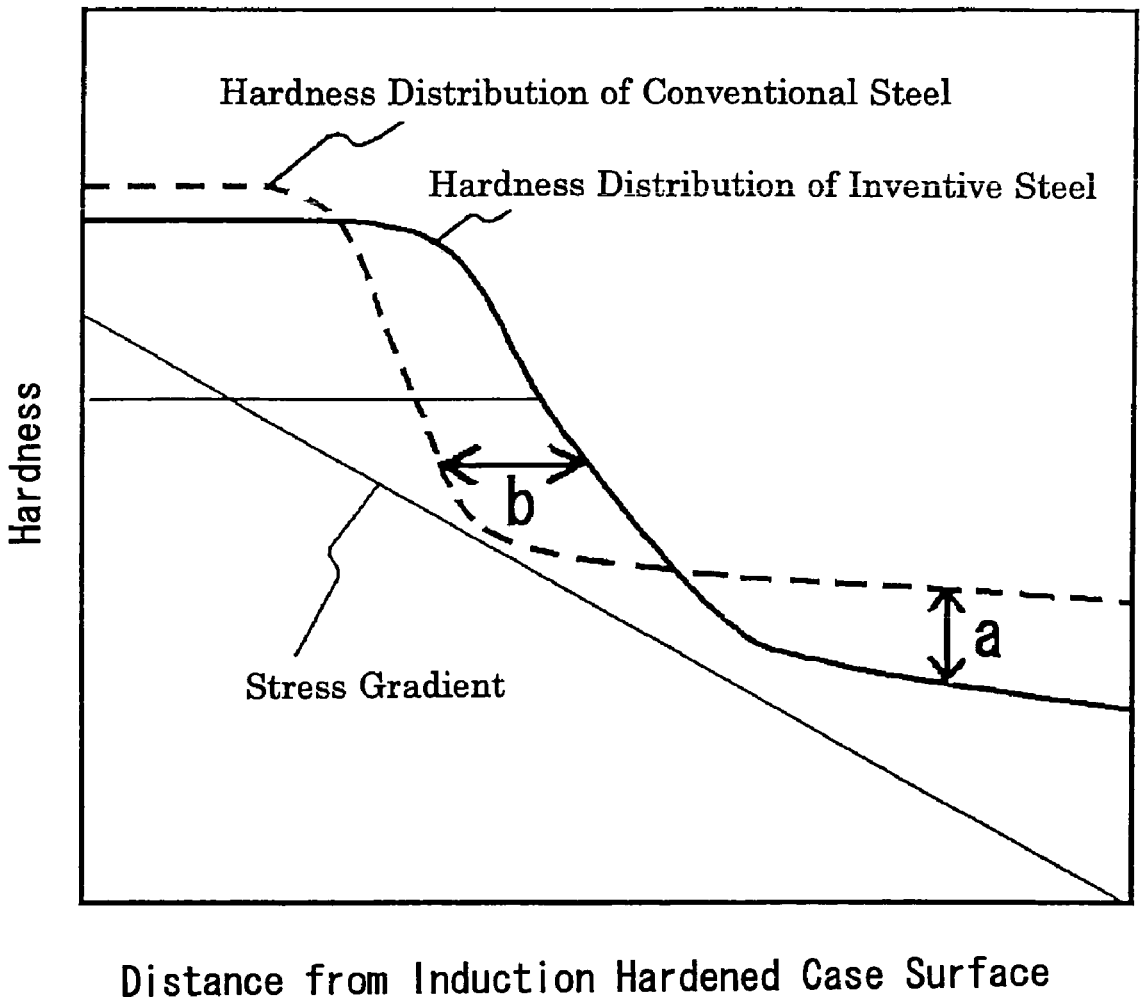
[FIG. 1]
Figure 2:
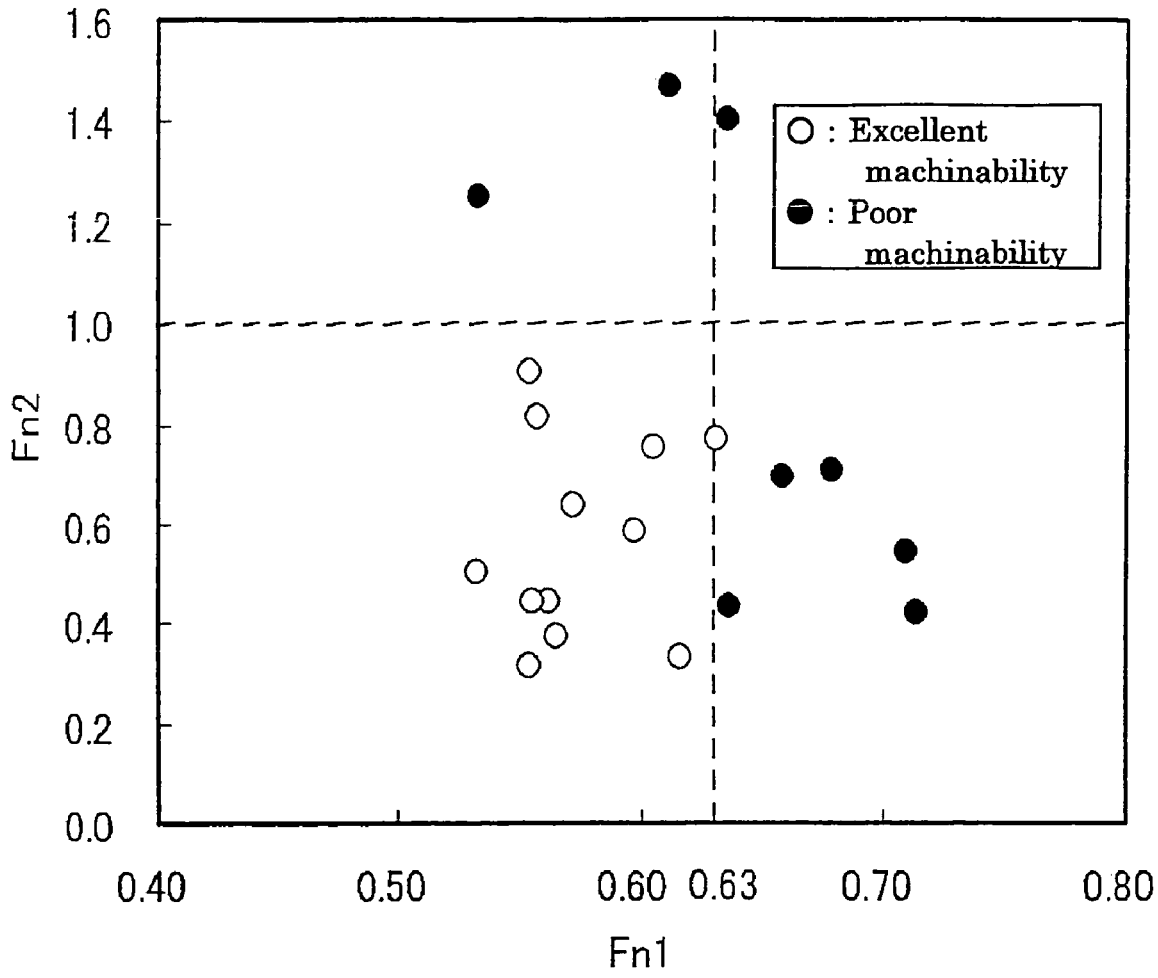
[FIG. 2]
Figure 3:
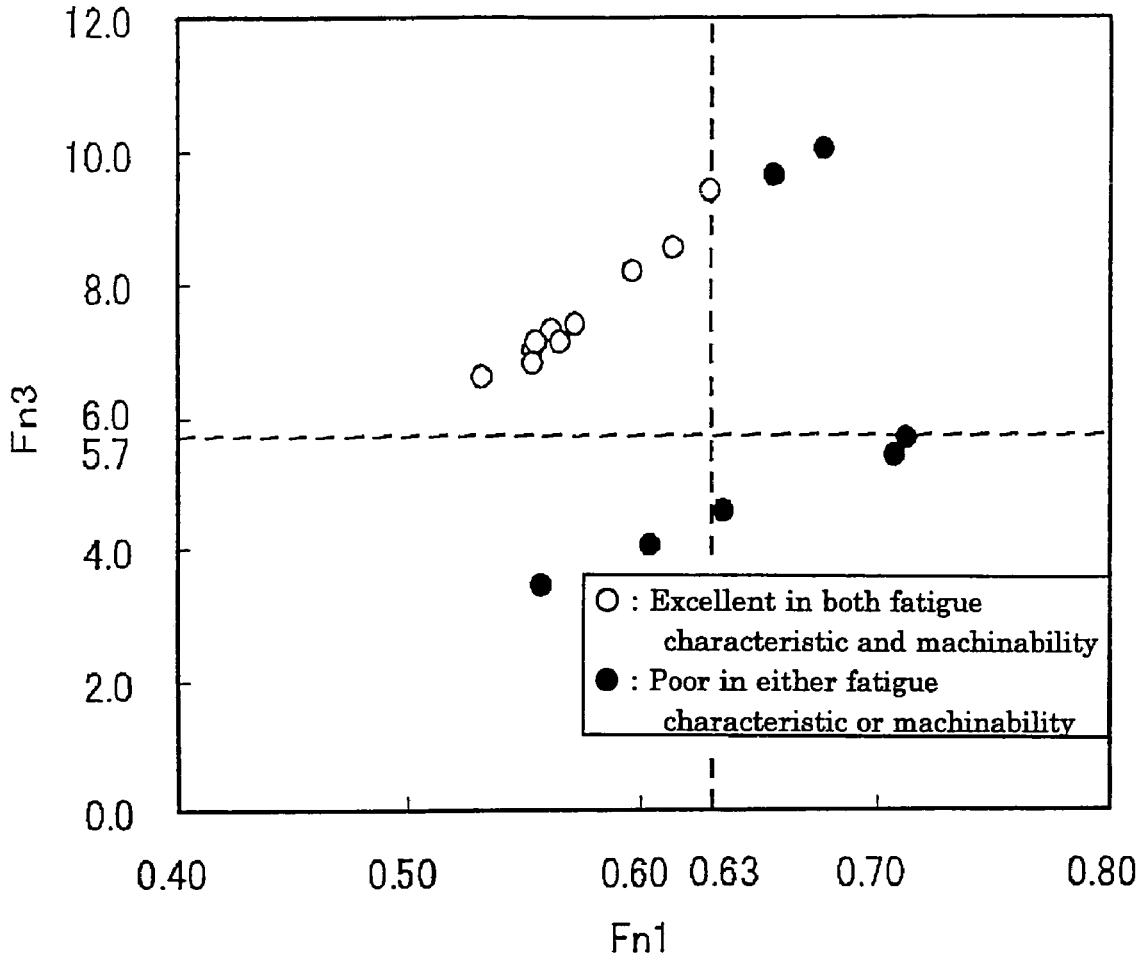
[FIG. 3]

What is claimed is:

1. A hot forged non-heat treated steel for induction hardening, which comprises by mass percent, C: 0.35 to 0.45%, Si: 0.20 to 0.60%, Mn: 0.40 to 0.80%, S: 0.040 to 0.070%, Cr: 0.10 to 0.40%, Ti: 0.030 to 0.100%, Ca: 0.0005 to 0.0050%, B: 0.0005 to 0.0030%, O (oxygen): 0.0015 to 0.0050%, Mo: 0 to 0.05%, P: 0.025% or less, V: 0.03% or less, Al: 0.009% or less and N: 0.0100% or less, with the balance being Fe and impurities, in which the value of Fn1 represented by the following equation (1) is 0.63 or less, the value of Fn2 represented by the following equation (2) is 1.0 or less, and the value of Fn3 represented by the following equation (3) is 5.7 or more:

$$Fn1=C+(Si/10)+(Mn/5)+(5Cr/22)+1.65V-(5/7S)+1.51\times(Ti-3.4N), \quad \text{Equation (1)}$$

$$Fn2=Ca/O, \quad \text{Equation (2)}$$

$$Fn3=25.9\times Fn1+27.5\times(Ti-3.4N)-7.9. \quad \text{Equation (3).}$$

* * * * *